US010538931B2

(12) United States Patent
Patel et al.

(10) Patent No.: US 10,538,931 B2
(45) Date of Patent: Jan. 21, 2020

(54) STAND FOR A STADIUM, AND A METHOD FOR DETERMINING THE STAND CONFIGURATION

(71) Applicant: PATTERN DESIGN LIMITED, London (GB)

(72) Inventors: Dipesh Jagdish Patel, London (GB); Jon-Scott Kohli, London (GB); Nicholas Robert Tyrer, London (GB)

(73) Assignee: Pattern Design Limited, Greater London (GB)

( * ) Notice: Subject to any disclaimer, the term of this patent is extended or adjusted under 35 U.S.C. 154(b) by 288 days.

(21) Appl. No.: 14/783,665

(22) PCT Filed: Apr. 11, 2014

(86) PCT No.: PCT/GB2014/051133
§ 371 (c)(1),
(2) Date: Oct. 9, 2015

(87) PCT Pub. No.: WO2014/167345
PCT Pub. Date: Oct. 16, 2014

(65) Prior Publication Data

US 2016/0069097 A1 Mar. 10, 2016

(30) Foreign Application Priority Data

Apr. 12, 2013 (GB) ..... 1306723.6

(51) Int. Cl.
*E04H 3/12* (2006.01)

(52) U.S. Cl.
CPC ..... *E04H 3/12* (2013.01)

(58) Field of Classification Search
CPC ..... E04H 3/12
USPC ..... 52/6, 8
See application file for complete search history.

(56) References Cited

U.S. PATENT DOCUMENTS 1,088,239 A * 2/1914 Paine ..... B63B 9/06 114/65 A
1,444,360 A 2/1923 Burton
1,795,331 A * 3/1931 Davidson ..... E04B 7/08 52/169.7

(Continued)

OTHER PUBLICATIONS

Pieper Sports Facility Consulting, Sightline Analysis, www.piepersfc.com/index_files/Page1012.htm, 4 pages (Year: 2008).*

(Continued)

*Primary Examiner* — Joshua J Michener
*Assistant Examiner* — James J Buckle, Jr
(74) *Attorney, Agent, or Firm* — Kristin L. Murphy; Honigman LLP

(57) ABSTRACT

The present disclosure relates to a stand for a stadium. The stand comprises, a plurality or rows, each row containing a plurality of seats, and a structure having a width and a depth, wherein the plurality of rows of seats are mounted to the structure. The cross-sectional profile of the structure along the direction of the depth of the structure varies along the direction of the width of the structure such that a C-value for each of the plurality of seats is configurable. In a preferred embodiment, the C-value is configured to be substantially constant. A method of configuring the arrangement of such a stand is also disclosed.

11 Claims, 10 Drawing Sheets

(56) References Cited

U.S. PATENT DOCUMENTS

| | | | | |
|---|---|---|---|---|
| 1,882,148 | A * | 10/1932 | Jones | E04H 3/12 52/8 |
| 2,703,910 | A | 3/1955 | Hoffmeister | |
| 2002/0017844 | A1 * | 2/2002 | Parkyn | G09F 9/33 313/113 |
| 2013/0242263 | A1 * | 9/2013 | Anderson | G03B 21/00 352/38 |
| 2015/0240506 | A1 * | 8/2015 | Ruhmann | A47C 1/12 52/8 |

OTHER PUBLICATIONS

SMPTE—Jun. 1, 1990, "Design of Effective Cine Theaters", SMPTE—Motion Imaging Journal, Society of Motion Picture and Television Engineeers, White Plains , NY, US, vol. 99, No. 6, pp. 493-495, XP000108088, ISSN: 0036-1682, the whole docoument.

PCT International Search Report and Written Opinion dated Oct. 23, 2014 for PCT/GB2014/051133.

* cited by examiner

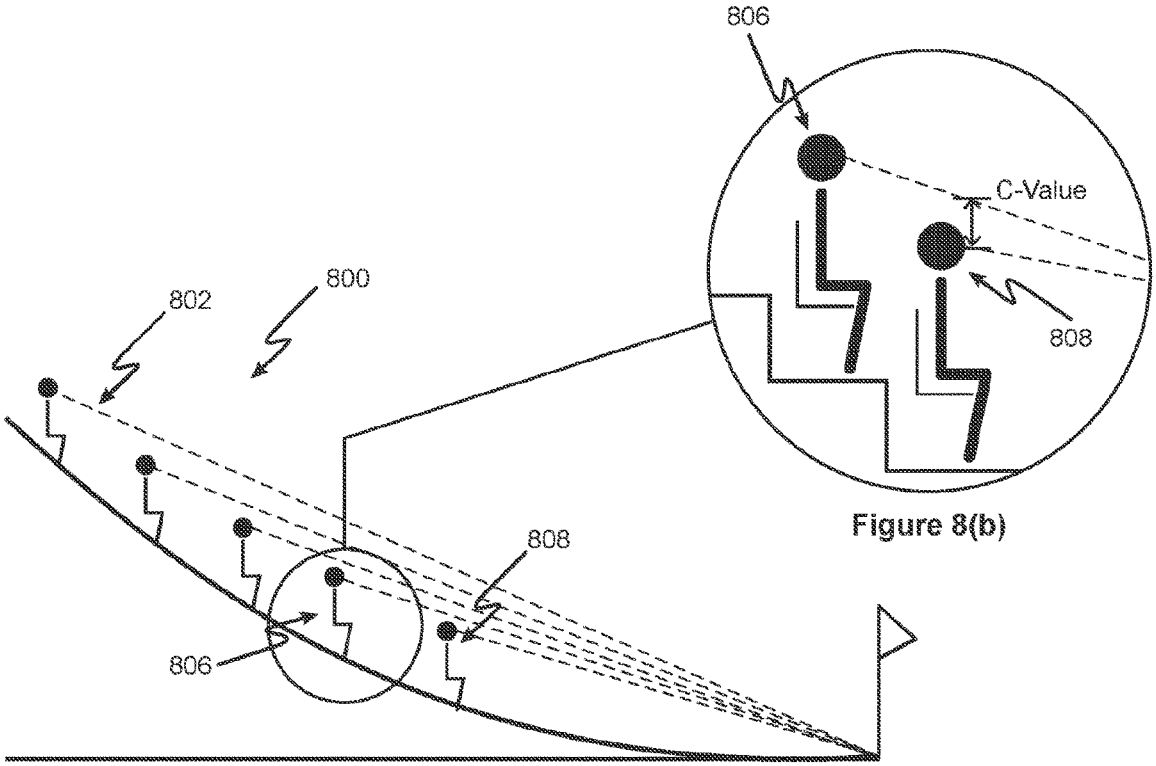
Figure 8(b)
Figure 8(a)
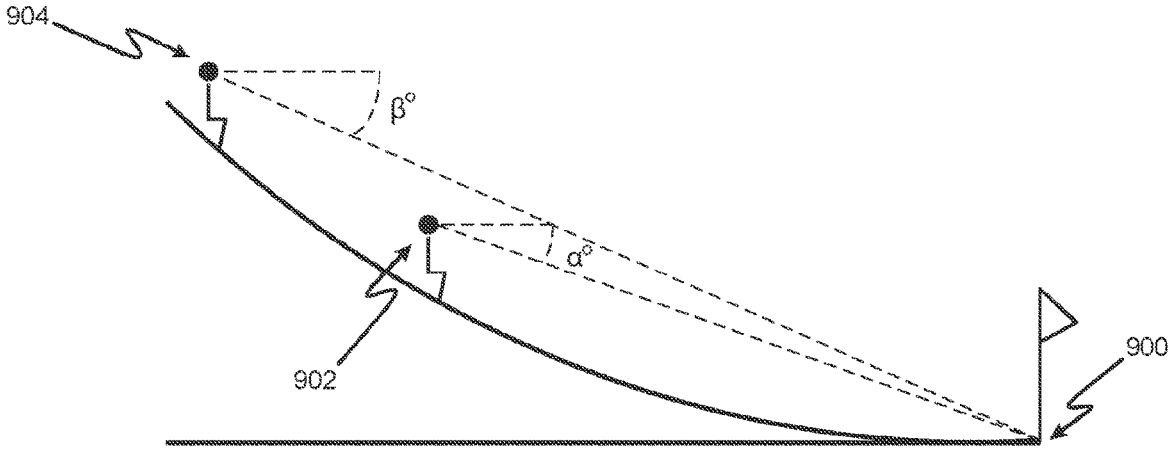
Figure 9

STAND FOR A STADIUM, AND A METHOD FOR DETERMINING THE STAND CONFIGURATION

CROSS-REFERENCE TO RELATED APPLICATION

This application is the U.S. national phase of PCT Application No. PCT/GB2014/051133 filed on Apr. 11, 2014, which claims priority to GB Patent Application No. 1306723.6 filed on Apr. 12, 2013, the disclosures of which are incorporated in their entirety by reference herein.

The present invention relates to a stand for a stadium, for example a sports stadium or the like. In particular, the present invention relates to a stand having an improved spectator viewing quality. The invention also relates to a method of determining the configuration of the stand.

There are numerous known arrangements for stadium seating and viewing areas. Many of the known arrangements, such as Greek and Roman stadia, have similar characteristics: generally curved seating (when viewed in plan); and a rising cross-sectional profile.

Modern sports stadia, with rectangular fields of play (FoP), led to spectator seating with straight sides running parallel to the sides of the FoP. The advantage of this arrangement is that every seat in a particular row is a constant distance from the edge of a rectilinear FoP. The disadvantage of this is a loss of atmosphere compared to curved seating because the spectator's peripheral field of view does not include any other spectators in the same row. To mitigate against this problem, stadia having curved sides (in plan view), similar to the Greek and Roman stadia but for rectilinear FoP, were developed to bring adjacent spectators in the same row into the peripheral field of view of the spectator. A second advantage of such curved sides is that seating away from the centre, approaching the ends of each stand, is aligned (at least to some degree) to the centre of the FoP rather than perpendicular to the side. Given these advantages, as well as the need to provide more space at the centre of the FoP for support services and the like, curved seating geometries have become popular again.

In order to provide an object measure of the viewing quality for each spectator, the C-value may be used which for any first spectator is defined as the vertical distance between the sight-line of the first spectator, and the eye-level of a second spectator sitting directly in front of the first spectator; the C-value is described in further detail below. However, it is noted that the subtended angle of view is a significant factor in perceived (i.e. subjective) quality of view. That is to say, for two seats with identical C-values, having a similar distance to the focal point but with different elevations with respect to the focal point, the majority of spectators perceive the higher seat to have a better view.

To provide a consistent quality of view for each spectator, the aim is to provide every seat in a given stand, tier, or zone with the same C-value. To provide the same C-value for straight seating, a parabolic cross-sectional profile is used. However, where curved seating is used for rectilinear FoPs the C-value varies for each seat as the distance between the seat and the focal point on the FoP varies.

When curved seating is used, the C-values will be higher than average near the centre of the stand, tier, or zone, and lower than average towards the ends. Such a seating layout results in the seating being larger in height and depth, which adds cost, reduces the proximity of the spectator to the focal point on the FoP, but varies the quality of view for each spectator.

It is thus an object of the present invention to provide a seating layout which mitigates the problems associated with known straight and curved seating layouts. According to the present invention, there is provided a stand for a stadium. The stand comprises: a plurality or rows, each row containing a plurality of seats; and a structure having a width and a depth, wherein the plurality of rows of seats are mounted to the structure. The cross-sectional profile of the structure along the direction of the depth of the structure varies along the direction of the width of the structure such that a C-value for each of the plurality of seats is configurable.

Thus, the present invention advantageously provides a stand for a stadium having substantially configurable C-values for each spectator seat, which may improve the viewing quality for the spectators, and improve the atmosphere perceived by each spectator.

As used herein, the term 'configurable' connotes that the C-value for each of the plurality of seats can be determined according to the requirements of the stand, and the FoP. The C-value can be configured by varying the rake, and shape, of the cross-sectional profile, along the direction of the depth of the structure, across the width.

As used herein, the term 'stand' refers to a tier, a zone, and an entire stadium or any substantial portion thereof.

Preferably, the structure along the direction of the depth of the structure varies along the direction of the width of the structure such that a C-value for each of the plurality of seats is substantially constant. That is to say, the C-value for each of the plurality of seats may be configured to be substantially constant.

As used herein, the term 'substantially constant' when used in conjunction with the term 'C-value' connotes that the C-value for each seat is within 5% of the average C-value of the plurality of seats.

Preferably, the cross-sectional profile of the structure along the direction of the depth of the structure is parabolic. The cross-sectional profile of the structure along the direction of the depth of the structure preferably varies from a first parabolic profile at a first end of the stand to a second parabolic profile at a centre of the stand. More preferably, the cross-sectional profile of the structure along the direction of the depth of the structure varies from the second parabolic profile at the centre of the stand to a third parabolic profile at a second end of the stand. The first parabolic profile and the third parabolic profile may be substantially the same.

In an alternative embodiment, the first parabolic profile and the third parabolic profile may be different. In this example, the C-value is configured such that it is preferably substantially constant when the spectators are viewing focal points on the FoP having a varying distance from the stand. For example, where the FoP is a motor racing circuit which is curved in the locality of the stand, the cross-sectional profiles of the stand may be configured accordingly to provide the required C-value.

By providing a stand having such a varying profile, the C-value may be configured, or more preferably kept substantially constant.

The angle of rake of the seats at a first end of the stand is $\theta$, and the angle of rake of the seats at a centre of the stand is $\alpha$. Preferably, $\theta$ is greater than $\alpha$. As will be appreciated in this embodiment, the stand appears twisted, with a steeper angle of rake at the ends of the stand than in the centre.

In a further alternative embodiment, the cross-sectional profile of the structure along the direction of the depth of the structure is linear. Again, in this alternative embodiment, the angle of rake of the seats at a first end of the stand is $\theta$, and the angle of rake of the seats at a centre of the stand is $\alpha$.

Preferably, θ is greater than α. As will be appreciated in this embodiment, the stand appears twisted, with a steeper angle of rake at the ends of the stand than in the centre. Such a stand, or tier for a stand, may be appropriate when a parabolic cross-sectional profile is not possible, or not desirable.

The cross-sectional profile of the structure along the width of the structure of at least one of the plurality of rows is preferably curved, and may be parabolic. By providing a curved row, as seen from the FoP, the C-value may be configured more easily, and thus a stand having improved viewing quality may be provided.

The top row of seats may lie in a plane substantially parallel to the plane containing the FoP. In this embodiment, the bottom, or front, row of seats may be curved such that the height of the seat at the centre of the stand above the FoP is greater than the height of the seats at the ends of the stand. Providing such a planar top row of seats may enable a stand to be provided for a stadium set into the natural lie of the land more easily. For example, such a stand would be appropriate where the spectators enter the stadium at the level of the top row.

As will be appreciated, the FoP has been defined as the reference datum, but any other such suitable reference datum may be more appropriate in certain circumstances. For example, where the FoP is not level, such as a motor racing circuit, the reference datum may be a horizontal plane at the level of the lowest seat in the bottom row or it may vary to follow the rise and fall of the track.

In an alternative embodiment, the bottom row of seats lies in a plane substantially parallel to the plane containing the FoP. In this embodiment, the top, or back, row of seats may be curved such that the height of the seat at the centre of the stand above the FoP is less than the height of the seats at the ends of the stand. Providing such a planar bottom row of seats may enable a more conventional stand to be provided, such as for a sports stadium.

In a particularly preferred embodiment, the side of the stand adjacent the FoP is curved when viewed in plan. Providing such a curved-side may enable the bottom, or front, row of seats to be closer to the edge of the FoP than compared to a conventional stadium. The present invention by providing a configurable, and in the preferred embodiment substantially constant, C-value enables an improved quality of view for the spectators at the ends of a stand.

In a conventional stadium the C-value generally decreases towards the end of the stand and thus the distance to the focal point of the FoP must increase to ensure the C-value is at least a minimum required for the stadium.

In an alternative embodiment, the side of the stand adjacent the FoP is straight when viewed in plan. Providing such a straight-side may enable a stand to be provided which is more appropriate to certain fields of play, such as a motor racing circuit.

In a yet further embodiment, the C-values for each seat are configured such that the proximity of the front, bottom, row of seats to the edge of the FoP is minimised, the height of the stand is minimised, and each C-value in the stand is within 30% of the average C-value, preferably within 25%, more preferably within 10%. The above described simultaneous equations are solved to determine the required cross-sectional profiles of the stand.

According to a further aspect of the present invention, there is provided a method of configuring a stand for a stadium, the stand comprising a plurality of rows, each row containing a plurality of seats, and a structure having a width and a depth. The plurality of rows of seats are mounted to said structure. The method comprises determining a required C-value for each seat in the stand; determining a cross-sectional profile of the structure along the direction of the depth of the structure at a centre of the stand, such that each seat in the cross-section has a substantially constant C-value. The method further comprises determining a cross-sectional profile of the structure along the direction of the depth of the structure at a first end of the stand, such that each seat in the cross-section has a C-value substantially equal to the constant C-value, determining a cross-sectional profile of the structure along the direction of the depth of the structure at a second end of the stand, such that each seat in the cross-section has a C-value substantially equal to the constant C-value; varying the cross-sectional profile of the structure between the first end of the stand and the centre of the stand, and between the second end of the stand and the centre of the stand, such that the C-value for each seat in the stand is substantially constant.

The step of determining a required C-value for each seat in the stand, preferably comprises determining a single C-value for each seat in the stand. In this embodiment, the cross-sectional profiles are preferably arranged such that the C-value for each seat in the stand is within 5% of the average C-value.

In an alternative embodiment, the cross-sectional profiles are preferably arranged such that the proximity of the front, bottom, row of seats to the edge of the FoP is minimised, the height of the stand is minimised, and the C-value for each seat in the stand is within 30% of the average C-value, preferably within 25%, more preferably within 10%. The present invention solves the above simultaneous equations to determine the cross-sectional profiles of the stand.

As used herein, the term 'stadium' refers to any seating, or standing, arrangement for spectators to view a FoP, and includes sports stadium, arenas, temporary seating, theatres, press conference rooms, lecture theatres, parliament/debating chambers, cinemas, holographic and 3D cinemas, motor racing circuits, golf courses, and any other such venues which require spectator seating, or spectator viewing areas (where the spectator will be standing rather than sitting).

As used herein, the term 'width' refers to the direction substantially along a row of seats, and the term 'depth' refers to the direction substantially perpendicular to the 'width'.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which:

FIG. 8 show the C-value for a parabolic seating arrangement;

FIG. 9 shows the subtended angle of view of spectators across a cross-section of a known parabolic seating arrangement;

Figure 1:
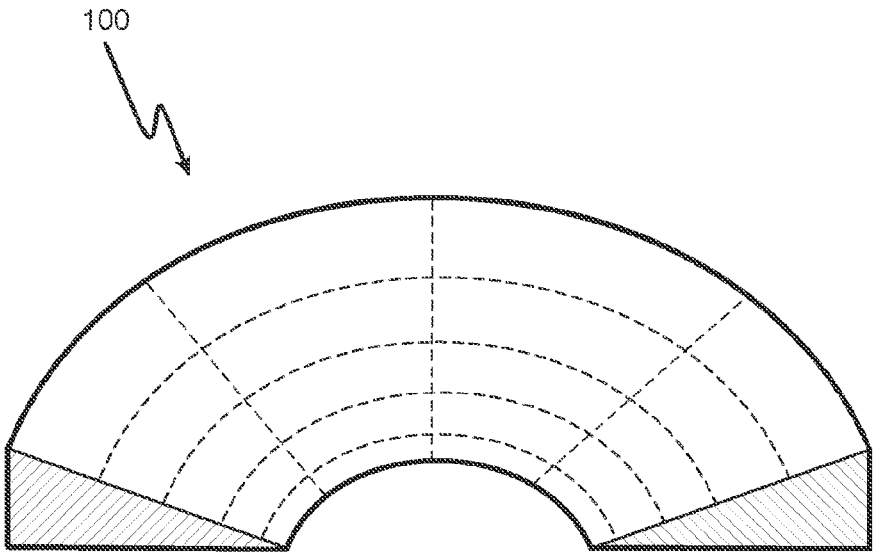
FIG. 1 shows a known Greek theatre.

FIG. 1 shows a known Greek theatre 100. In this known stadium design, the seating is curved (in plan view) and wraps around the FoP. As viewed in cross-section, the seating is generally provided on a structure having a constant angle of rake across its width, and thus the C-value, and the viewing quality, for the spectator will vary in dependence on the spectator's location in the stadium. However, providing the seating on a curve (in plan view) provides the spectator with an improved feeling of atmosphere as compared to straight-sided (in plan view) stadia.

Figure 2:
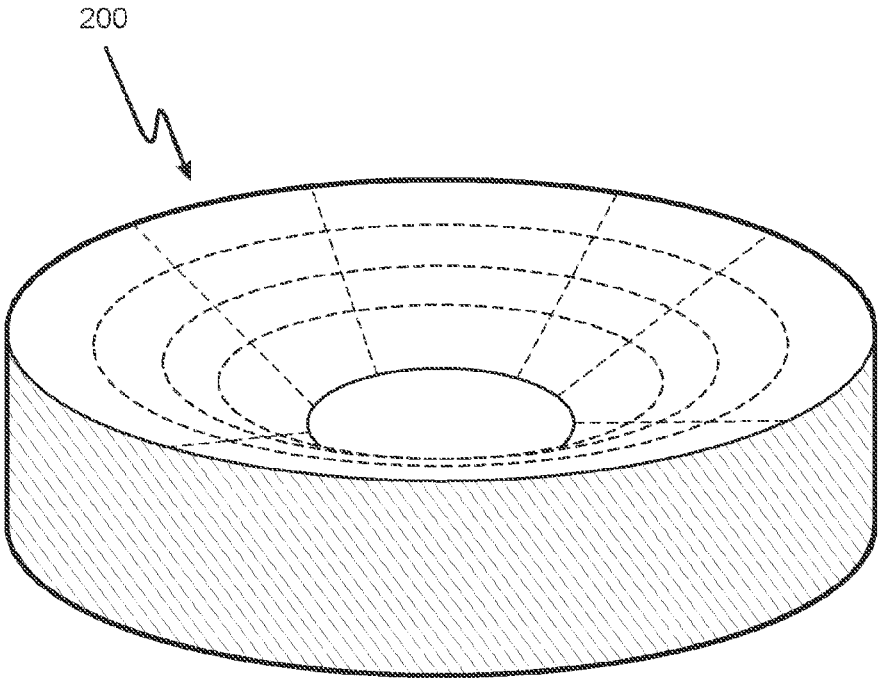
FIG. 2 shows a known elliptical Roman amphitheatre.

FIG. 2 shows a known elliptical Roman amphitheatre 200. In this known stadium design, the seating is again curved (in plan view) and wraps completely around the FoP, and thus is similar in design to more modern stadia. When viewed in cross-section, although the seating is also generally provided on a structure having a constant angle of rake across its width, the stadium is divided into various tiers, with each successive tier having a greater angle than the previous tier. Therefore, the tier furthest from the FoP has the largest angle in order to compensate for what would otherwise be a reduced C-value, and thus reduced viewing quality, for the spectator. However, similarly to the Greek theatre, the C-value, and viewing quality, will vary in dependence on the spectator's location in the stadium.

Figure 3:
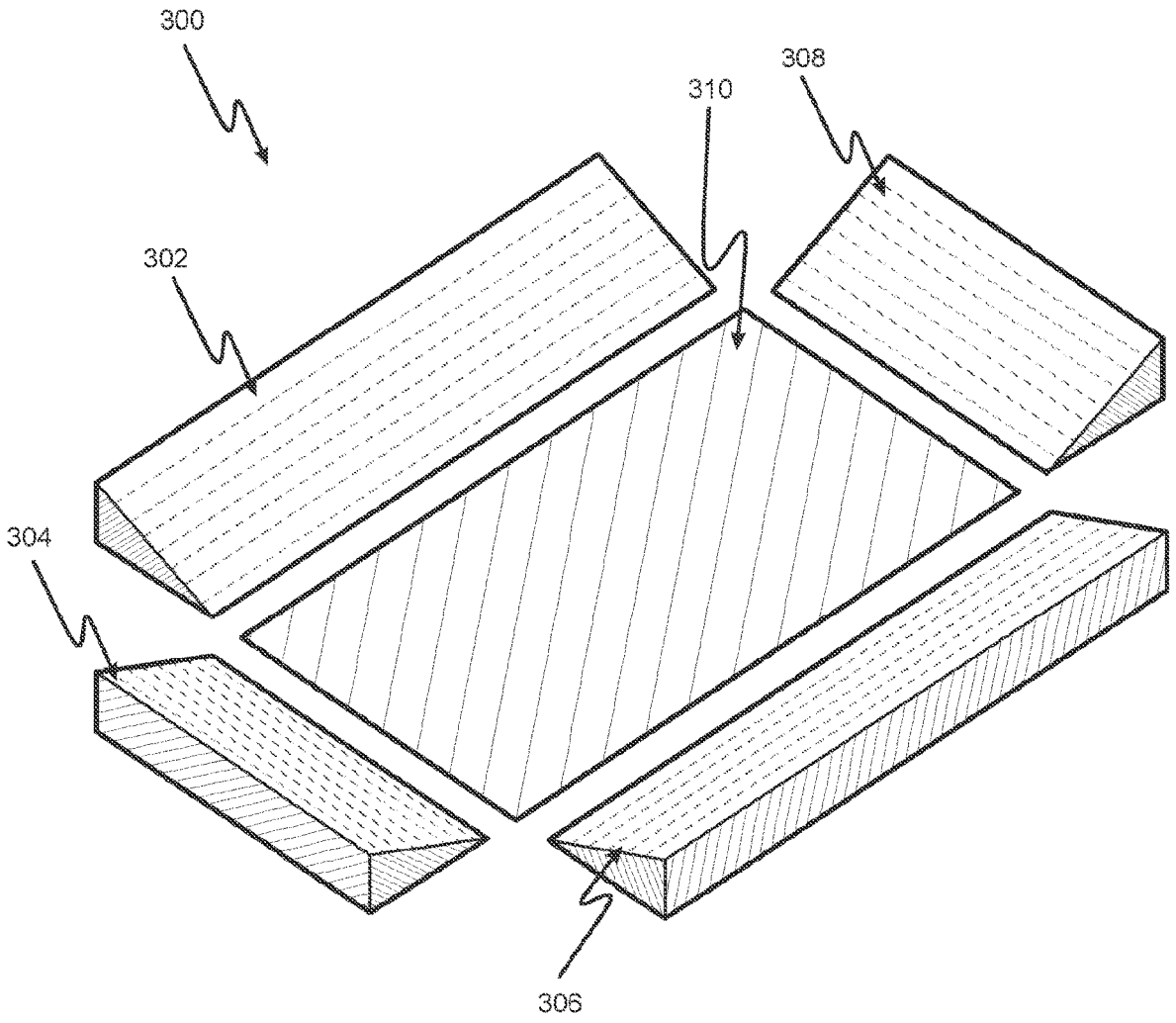
FIG. 3 shows a known straight-sided stadium.

FIG. 3 shows a known, more modern, stadium design 300 having four straight-sided (in plan view) stands 302, 304, 306 and 308. Each stand, in a similar way to the Greek theatre 100, or Roman amphitheatre 200, has a constant profile when viewed in cross-section, with some examples having straight profiles and others a constant parabolic profile. The constant parabolic profile, in conjunction with the straight-sides, provides each spectator in the stand with a consistent C-value when viewing a focal point on the FoP directly in front of the spectator (e.g. the touch line of a football pitch). However, the straight-sides of the stand reduce the spectator's feeling of atmosphere within the stadium because the peripheral field of view of each spectator does not include spectators within the same row. Nevertheless, this known stadium design provides the advantage of a minimal distance between the front row of seats and the edge of the FoP.

Figure 4:
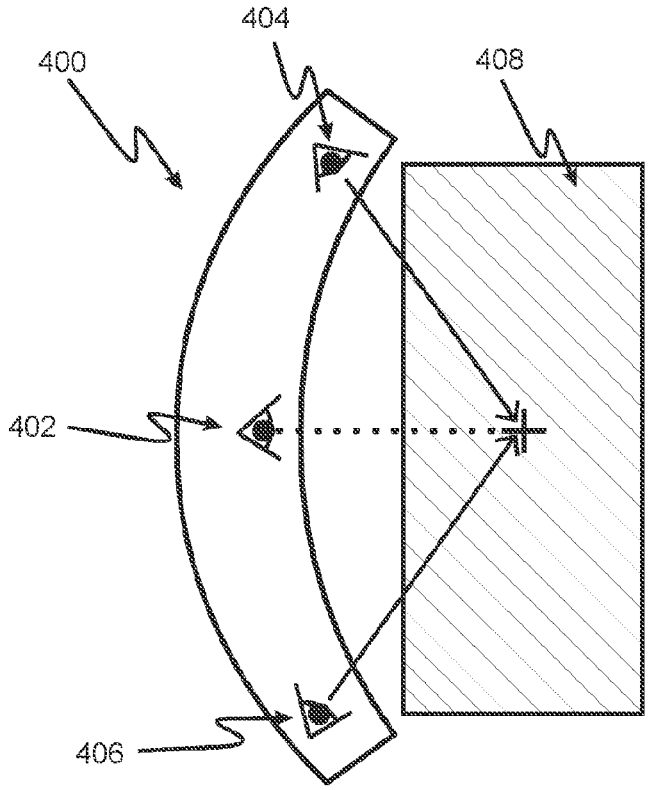
FIG. 4 shows the peripheral field of view of a spectator viewing a FoP.

FIG. 4 shows the seating alignment of known curved-sided stadiums 400. As can be seen, the curved seating is arranged such that each spectator 402, 404 and 406 effectively faces the same central zone on the FoP without having to rotate their heads. These known curved-sided stadiums 400 improve the spectators feeling of atmosphere, but lead to the C-value, and the viewing quality, reducing from the section of the stadium at the centre towards the section of the stand at the 'corner'.

Figure 5:
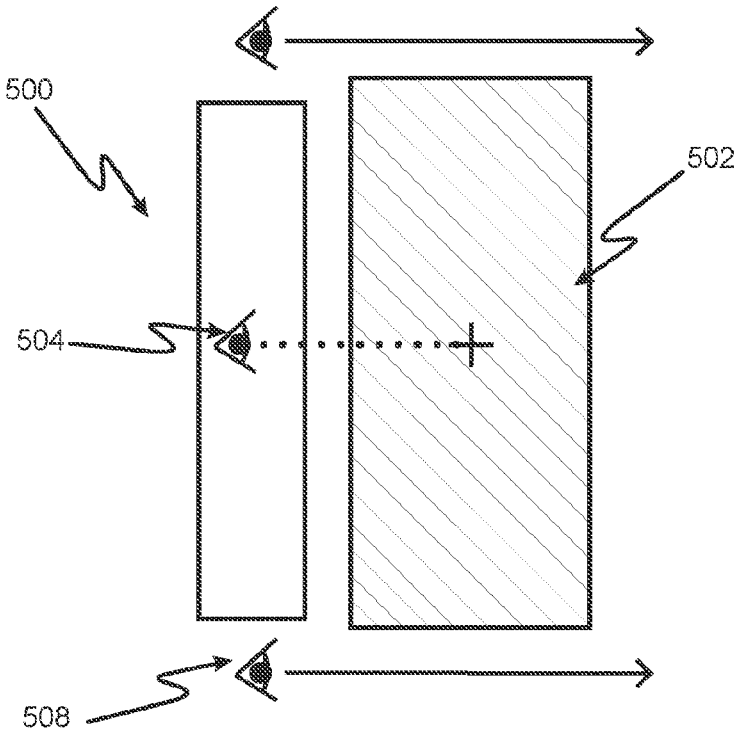
FIG. 5 shows the seating alignment of known curved-sided seating.

In comparison, FIG. 5 shows the seating alignment of known straight-sided stadiums 500. As can be seen, the straight seating is arranged to minimise the distance between the front row and the edge of the FoP 502, but the spectators 504, 506, and 508 face in the same direction and thus spectators 506 and 508 would be required to rotate their heads to view the same point on the FoP as spectator 504 is naturally facing.

Figure 6:
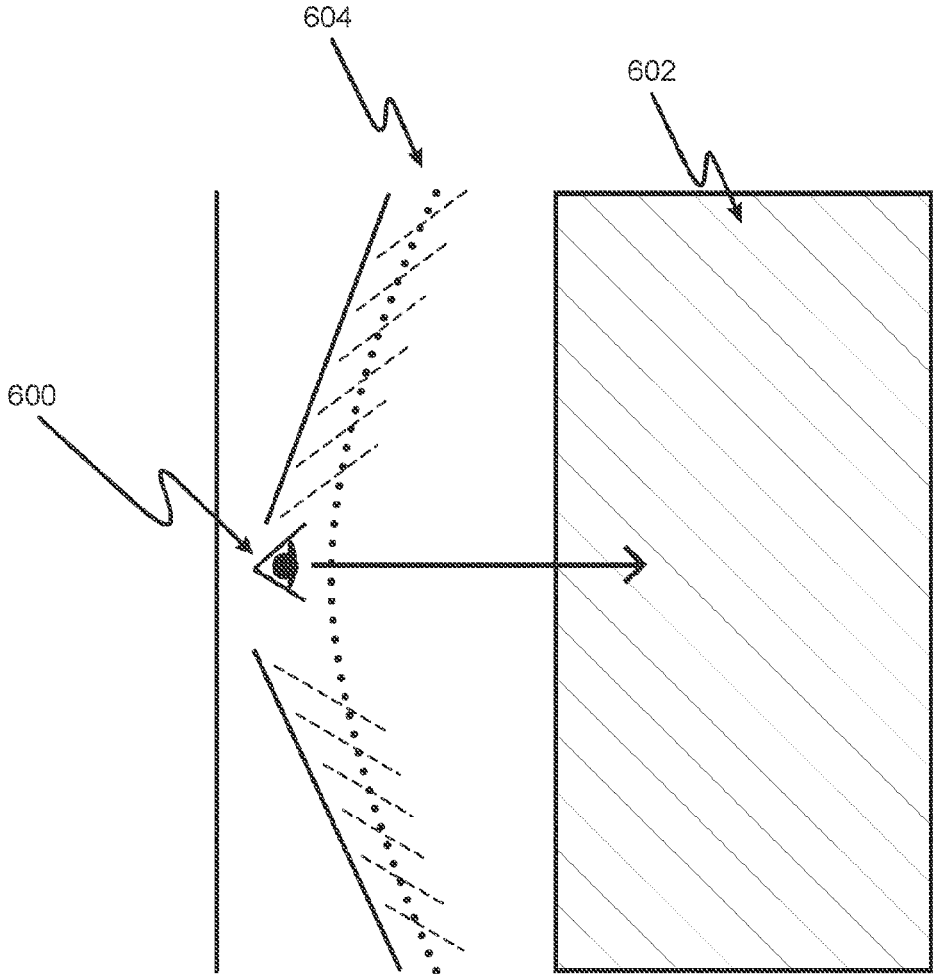
FIG. 6 shows the seating alignment of known straight-sided seating.

FIG. 6 shows the peripheral field of view for a spectator 600 viewing a FoP 602. As described above, it has been shown that the subjective viewing quality for a spectator may be increased if the spectator's peripheral field of view includes spectators seated within the same row as the spectator 600. Dotted line 604 indicates an ideal layout of a row of seats to achieve the spectator's peripheral field of view including spectators seated in the same row.

Figure 7:
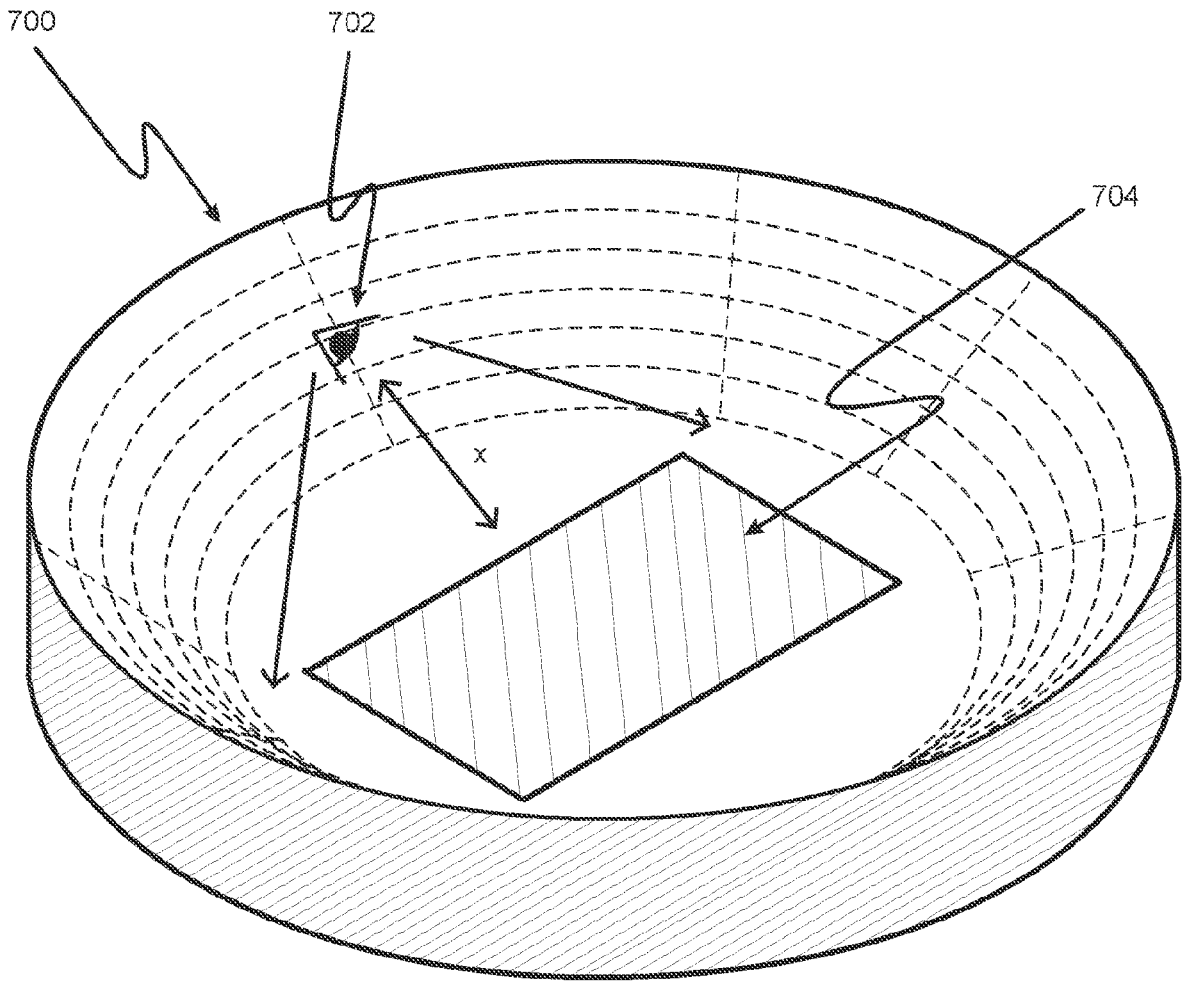
FIG. 7 shows a known curved-sided stadium showing peripheral field of view of a spectator.

FIG. 7 shows a known stadium design 700 having curved sides to provide the spectator 702 with a peripheral field of view incorporating spectators in the same row of seats as described above with reference to FIG. 6. As can be seen, the curved-sided seating increases the distance X from the front row of seats to the edge of the FoP 704.

FIGS. 8(*a*) and 8(*b*) show the C-value for a parabolic seating arrangement. FIG. 8(*a*) shows a cross-sectional view of the stadium stand 800 along the direction of the depth of the stand. The lines of sight for each spectator as shown as dashed lines 802. The focal point 804 of each spectator is the same, and in this case corresponds to the edge of the FoP, such as a side line on a football pitch. As shown in FIG. 8(*b*), the C-value for any given spectator 806 is defined as the vertical distance between the sight-line of that spectator 806, and the eye level of a spectator 808 sitting directly in front of spectator 806. When configuring and designing a stand for a stadium it is assumed that each spectator has the same seated eye height. This constant seated eye height is used, for example, when determining the dimensions of the front, bottom, row of the stand, and then to determine the cross-sectional profile of the stand to provide the required C-value. For example, a seated eye height for the spectators of 1200 mm or 1250 mm may be used.

For the C-value to remain constant for all spectators in any particular cross-section along the direction of the depth of the stand, it can be shown that a parabola is formed; this can be seen in FIG. 8(*a*). The cross-sectional profile will thus conform to the following equation:

$$y=ax^2+bx+c$$

Where a, b and c are constants.

FIG. 9 shows the variation of the subtended angle for each spectator when viewing the focal point 900 on the FoP. The spectator 902 has a subtended angle of view of $\alpha$, and spectator 904 has a subtended angle of view of $\beta$. As can be seen, the angle $\beta$ is greater than the angle $\alpha$. As will be appreciated, for a stand having a parabolic cross-sectional profile, the subtended angle of view increases as the distance from the FoP increases. It has been found that two spectators each provided with a seat having equal C-values will consider the seat having the greater subtended angle of view as providing a better quality view even though the actual extent of the FoP which can be viewed by each spectator is effectively the same.

Figure 10:
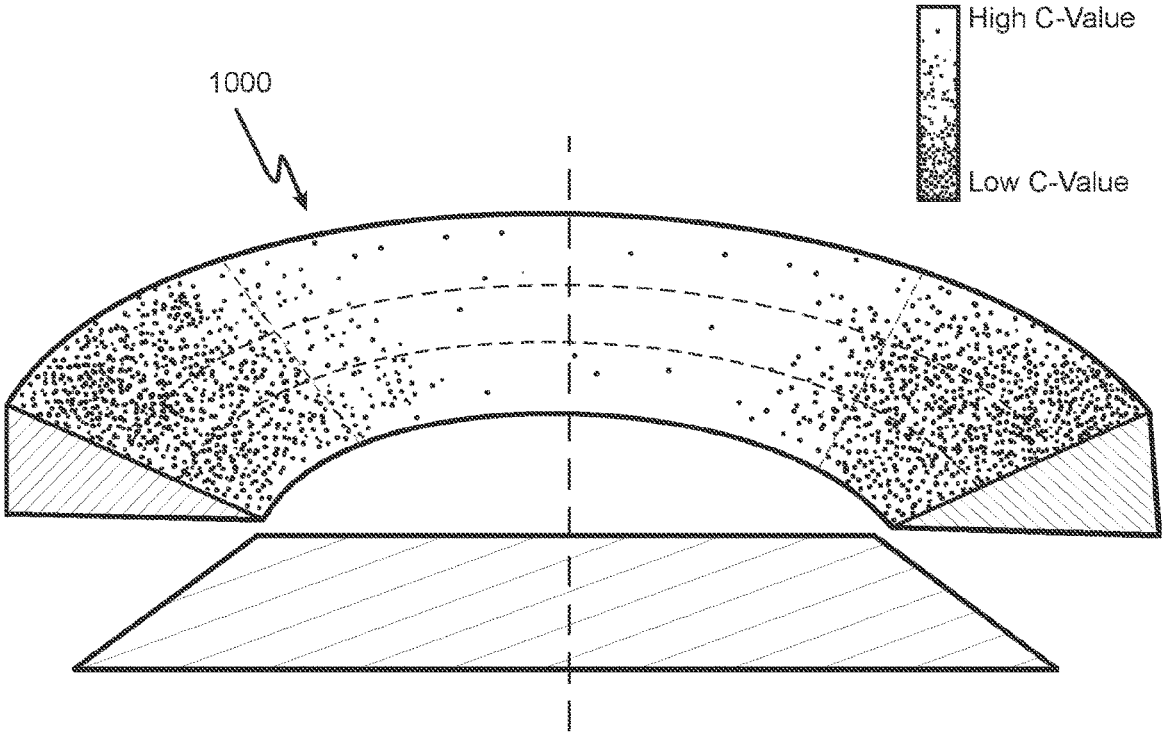
FIG. 10 shows the variation of C-value for a known curved-sided stadium.

FIG. 10 shows a known curved-sided stand 1000 for a stadium having a substantially constant parabolic cross-sectional profile across its width. As represented by the uneven distribution of dots, the C-value varies from above average at the centre of the stand to below average at the ends of the stand.

Figure 11:
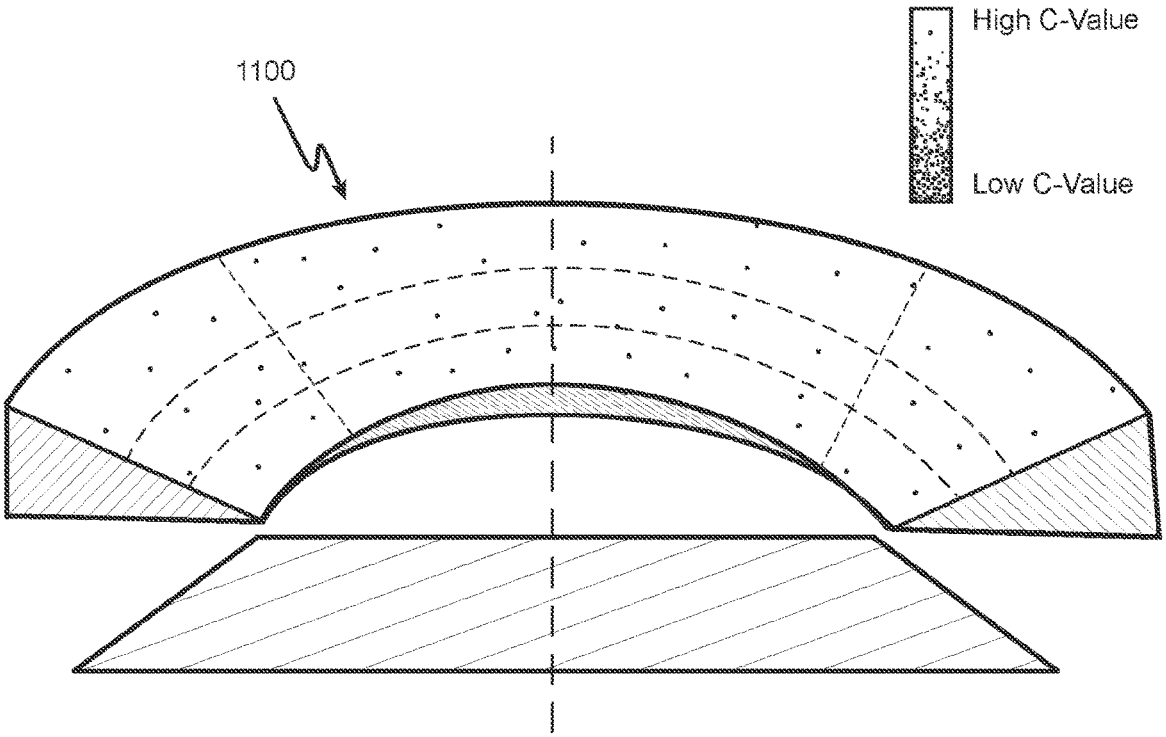
FIG. 11 shows an example stadium of the present invention having substantially constant C-values for each spectator.

FIG. 11 shows a curved-sided stand 1100 for a stadium according to the present invention. As represented by the even distribution of the dots, the C-value is substantially constant for each seat within the stand. The substantially constant C-value is achieved by varying the cross-sectional profile of the stand. The profile varies from the centre of the stand towards the edges, each edge having substantially the same profile. As will be appreciated the stand is therefore symmetric about the centre. As described above, the cross-sectional profile is parabolic to achieve a substantially constant C-value from the front of the stand to the back for any particular cross-section. However, for simplicity, the figures described herein are not shown with parabolic profiles. The cross-sectional profile determined for the centre of the stand to achieve the required C-value is 'twisted' to achieve the same C-value at the ends of the stand. The cross-sectional profile varies smoothly between the centre profile and the end profiles. Alternatively, in order to reduce manufacturing and construction complexities, a plurality of sections, each having a different cross-sectional profile, may be provided. In this alternative, the cross-sectional profile of each of the discrete plurality of sections is different to the previous section. A stand may comprise between 2 and 100 or more sections, each section having a constant but different cross-sectional profile. The change from the cross-sectional profile at the centre of the stand to the cross-sectional profile at the end of the stand is divided into an integer number of increments to determine the cross-sectional profile of each section.

For example, where a stand comprises 7 sections, the change from the cross-sectional profile at the centre of the stand to the cross-sectional profile at the end of the stand is divided into 3 increments. Thus, a first section is provided with the centre cross-sectional profile and then a further 3 sections are provided, the last having the cross-sectional profile required for the end of the stand. In this way, some repetition of sections can be achieved which may reduce the manufacturing complexities where, for example, pre-cast concrete sections are used. For example: stands for cinemas may comprise between 2 and 5 sections; stands for field sports, such as soccer, American football, or the like, may comprise between 7 and 15 sections; and stands for motor racing circuits may comprise between 7 and 100 or more sections. It will be appreciated that the actual number of sections required for any particular stand will be dependent on the particular stand design and use, and the above example should not be considered as limiting in any way.

However, where in-situ cast concrete is utilised to construct the structure for the stand, a constant, smooth, variation may be achieved. Similarly, other construction methods such as using steel, timber etc. could have constant or stepped variation depending on the construction method employed.

Figure 12:
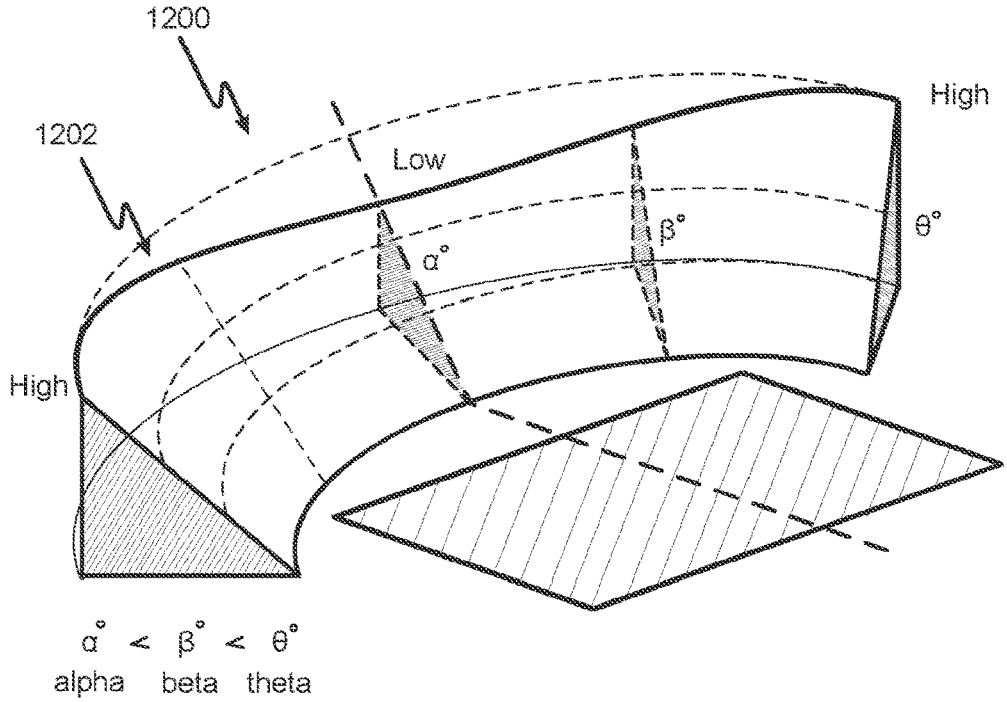
FIG. 12 shows a further example stadium of the present invention having a substantially level front row of seats.

FIG. 12 shows a particular example of a stand 1200 of the present invention having a substantially level front, bottom, row of seats. The stand 1200 has been configured to be constrained such that the front, bottom, row of seats lies in a plane that is parallel to the plane containing the FoP. In general, this constraint would lead to the front, bottom, row of seats being horizontal. As can be seen, this constraint leads to the top row of seats 1202 having a curved elevation across the width of the stand. Thus, the top row of seats is lower at the centre of the stand as compared to the ends of the stand. As described above, the cross-sectional profile is 'twisted' from the centre of the stand towards the ends of the stand. This is shown in the angle of rake of particular cross-sections of the stand. The angle of rake at the centre of the stand is a, the angle of rake at a mid-point between the centre of the stand and the end of the stand is $\Theta$, and the angle of rake at the end of the stand is $\theta$. The angles conform to the formula:

$$\alpha<\beta<\theta$$

Figure 13:
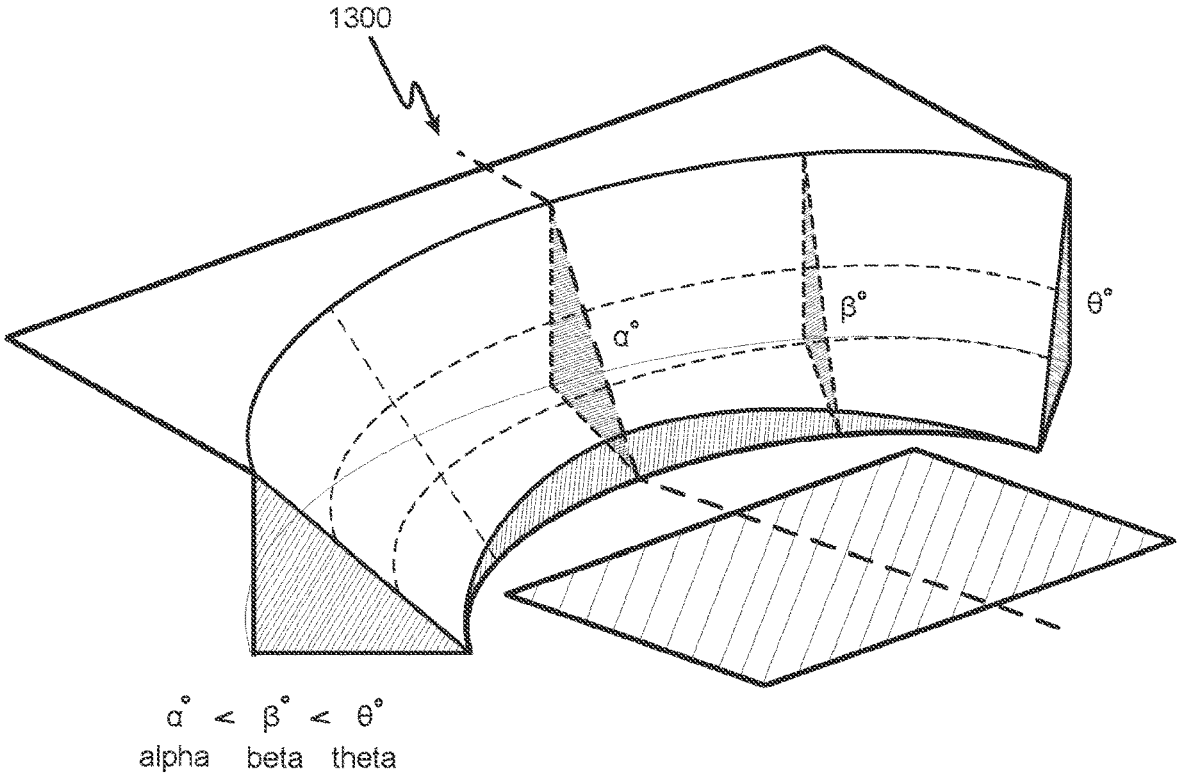
FIG. 13 shows a yet further example stadium of the present invention having a substantially level back row of seats.

FIG. 13 shows a yet further example stand 1300 for a stadium of the present invention having a substantially level back row of seats. The stand 1300 has been configured to be constrained such that the top, back, row of seats lies in a plane that is parallel to the plane containing the FoP. In general, this constraint would lead to the top, back, row of seats being horizontal. As can be seen, this constraint leads to the bottom, front, row of seats 1302 having a curved elevation across the width of the stand. Thus, the bottom row of seats is higher at the centre of the stand as compared to the ends of the stand. The same 'twist' is provided as described above in relation to FIG. 12, and thus the angle of rake of each section of the stand conforms to the above formula.

Figure 14:
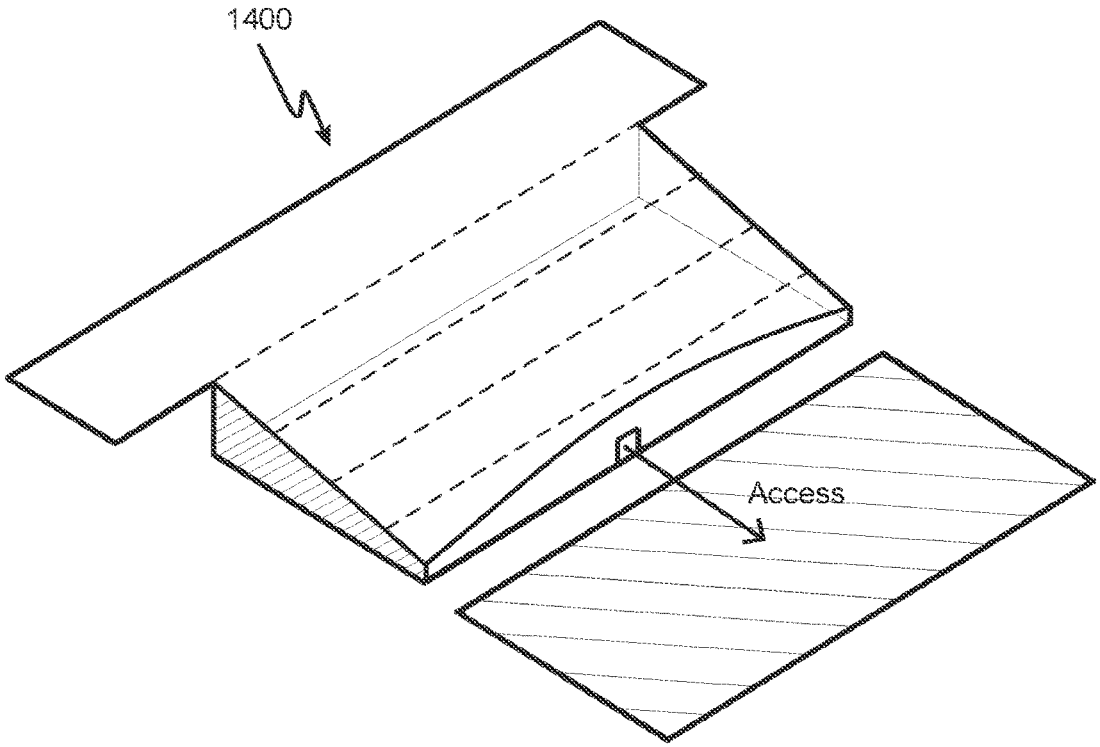
FIG. 14 shows a yet further example stadium of the present invention having a curved front row of seats to provide space for access to the FoP.

FIG. 14 shows a yet further example of a stand 1400 for a stadium of the present invention having a curved front row 1402 of seats to provide space for access 1404 to the FoP. The side of the stand 1400 adjacent the FoP is substantially straight, and thus the change in cross-sectional profile enables the height of the front row of seats at the centre of the stand to be higher than at the ends of the stand creating access to the FoP. This may be particularly advantageous where player benches, etc, may otherwise block the view of the spectators. By changing the cross-sectional profile across the width of the stand the C-value for each seat in the stand can be configured.

Figure 15:
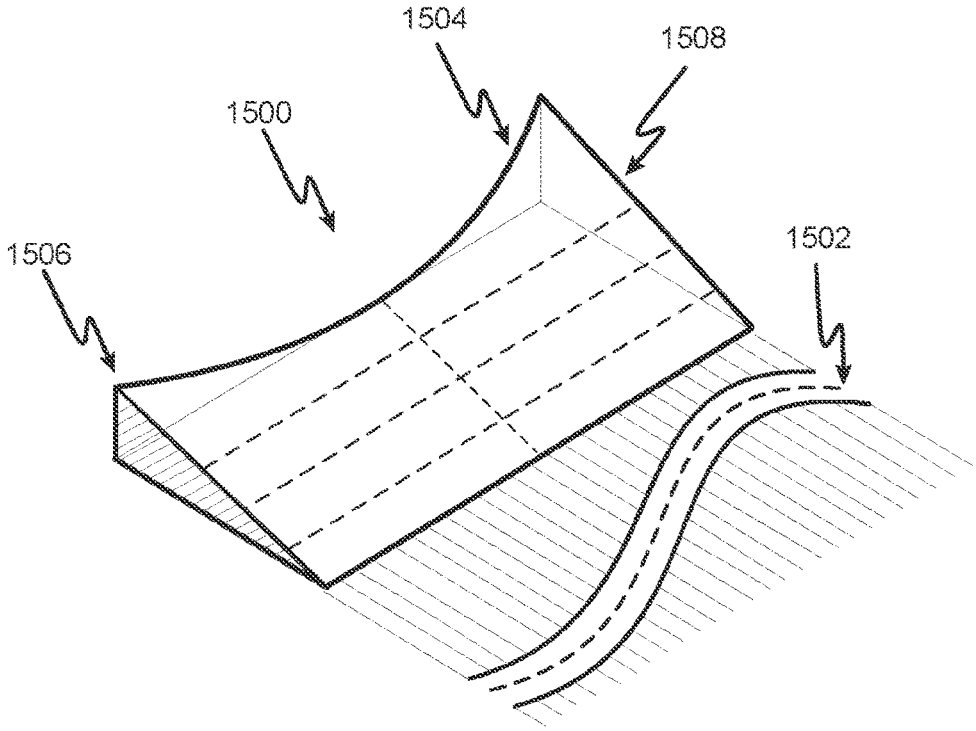
FIG. 15 shows a yet further example stadium of the present invention having a curved back row of seats.

FIG. 15 shows a yet further example of a stand 1500 for a stadium of the present invention having a curved back row of seats. The stand 1500 may be for a motor racing circuit 1502, and thus the FoP is non-linear and more difficult to provide a good quality of view for each spectator. As can be seen, the stand has been constrained such that the front row of seats is level, and as described above this results in the back row of seats being curved (the seats at the centre of the stand are lower than the seats at the ends of the stand). However, in order to provide a substantially constant C-value for each spectator the end 1506 has a different cross-sectional profile to the cross-sectional profile at the end 1508. In this example, this results in the seats at the end 1508 being higher than the seats at the end 1506. Again, each cross-sectional profile is parabolic.

Figure 16:
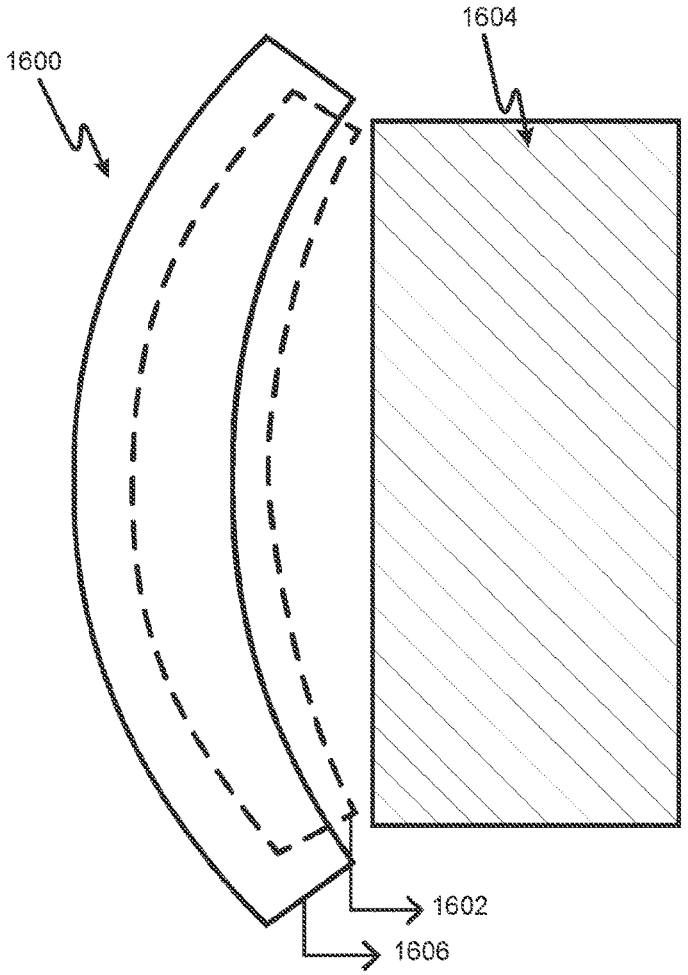
FIG. 16 shows a plan view of a comparison of a known seating arrangement and a seating arrangement according to the present invention.

FIG. 16 shows a plan view of a comparison of a known seating arrangement and a seating arrangement 1600 according to the present invention. As will be appreciated from the above, the present invention enables the front row of seats 1602 represented by the dashed line, to be closer to the FoP 1604 than for a conventional seating arrangement 1606 represented by solid lines, to provide stands having similar C-values. The front row of seats may be closer because the conventional seating arrangement is constrained by the ends of the stand having low C-values, and thus to achieve the minimum C-value required by a stadium to provide a suitable viewing quality, the front row of seats must be further from the edge of the FoP. As a result, the back, top, row of seats may also be closer to the FoP and thus the foot-print of the stadium may be reduced as compared to a conventional stadium having the same capacity. It has been found that this is a particular advantage for multi-tiered stands.

Figure 17:
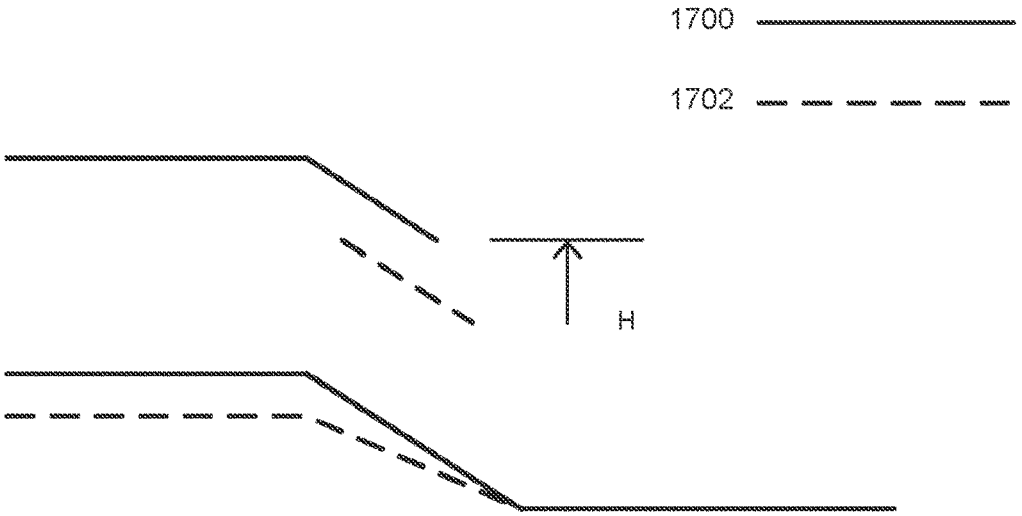
FIG. 17 shows a cross-sectional view of a comparison of a known seating arrangement and a seating arrangement according to the present invention.

In addition, the overall height of the stand may be reduced as compared to a conventional stadium design. FIG. 17 shows a cross-sectional view of a comparison of a known seating arrangement and a seating arrangement according to the present invention. As can be seen, the height H of the conventional seating 1700 represented by the solid line is higher above the FoP than for the stand 1702 according to the present invention represented by the dashed line. The overall height of the stand may be reduced because conventional stadium design is constrained by the minimum C-value required by the stadium which will generally be at the end of the stand. This constraint requires additional height of the stand to ensure the C-value at the ends of the stand meets the minimum requirement. For example, it has been found that the overall height, and therefore manufacturing and construction costs, for a stand having curved sides with a radius of approximately 185 m, offset 14 m from the FoP reduces the height by approximately 800 mm over approximately 31 rows of seats.

As will be appreciated, the present invention may be applicable to any stadium, but in particular it is applicable to; sports stadium, arenas, temporary seating, theatres, press conference rooms, lecture theatres, parliament/debating chambers, cinemas, holographic and 3d cinemas and motor racing circuits.

The invention claimed is:

1. A stand for a stadium, comprising: a plurality of rows, each row containing a plurality of seats; and a structure having a width and a depth, wherein the plurality of rows are mounted to said structure; wherein, a cross-sectional profile of the structure along a direction of the depth of the structure varies along a direction of the width of the structure in the form of a parabola such that a C-value for each of the plurality of seats is configurable within 5% of an average C-value, wherein the C-value for each seat is defined as the vertical distance between a sight-line of a first spectator in one of said plurality of seats, and an eye level of a second spectator sitting in another one of said plurality of seats, directly in front of the first spectator; wherein said average C-value is calculated from all seats from said plurality of rows.

2. A stand according to claim 1, wherein, the cross-sectional profile of the structure along the direction of the depth of the structure varies from a first parabolic profile at a first end of the stand to a second parabolic profile at a centre of the stand.

3. A stand according to claim 2, wherein the cross-sectional profile of the structure along the direction of the depth of the structure varies from the second parabolic profile at the centre of the stand to a third parabolic profile at a second end of the stand.

4. A stand according to claim 3, wherein the first parabolic profile and the third parabolic profile are substantially the same.

5. A stand according to claim 1, wherein an angle of rake of the seats at a first end of the stand is $\theta$, and an angle of rake of the seats at a centre of the stand is $\alpha$, wherein $\theta$ is greater than $\alpha$.

6. A stand according to claim 1, wherein the cross-sectional profile of the structure along the width of the structure of at least one of the plurality of rows is parabolic.

7. A stand according to claim 1, wherein a top row of seats lies in a plane substantially parallel to the plane containing a field of play.

8. A stand according to claim 1, wherein a bottom row of seats lies in a plane substantially parallel to the plane containing a field of play.

9. A stand according to claim 1, wherein the side of the stand adjacent a field of play is curved when viewed in plan.

10. A stand according to claim 1, wherein the side of the stand adjacent the field of play is straight when viewed in plan.

11. A method of configuring a stand for a stadium, the stand comprising a plurality of rows, each row containing a plurality of seats, and a structure having a width and a depth, wherein the plurality of rows of seats are mounted to said structure, the method comprising: determining a required C-value for each seat in the stand, wherein the C-value for each seat is defined as the vertical distance between a sight-line of a first spectator in one of said plurality of seats, and an eye level of a second spectator sitting in another one of said plurality of seats, directly in front of the first spectator; determining a cross-sectional profile of the structure along a direction of the depth of the structure at a centre of the stand, such that each seat in the cross-section has a substantially constant C-value within 5% of an average C-value; determining a cross-sectional profile of the structure along the direction of the depth of the structure at a first end of the stand, such that each seat in the cross-section has a C-value substantially equal to the constant C-value within 5% of said average C-value; determining a cross-sectional profile of the structure along the direction of the depth of the structure at a second end of the stand, such that each seat in the cross-section has a C-value substantially equal to the constant C-value within 5% of said average C-value; and varying the cross-sectional profile of the structure between the first end of the stand and the centre of the stand using a parabolic cross-section, and between the second end of the stand and the centre of the stand, such that the C-value for each seat in the stand is substantially constant within 5% of said average C-value; wherein said average C-value is calculated from all seats from said plurality of rows.

* * * * *